United States Patent [19]

Kitamura et al.

[11] Patent Number: 4,985,070

[45] Date of Patent: Jan. 15, 1991

[54] HIGH STRENGTH NITROGEN-CONTAINING CERMET AND PROCESS FOR PREPARATION THEREOF

[75] Inventors: Kozo Kitamura; Takeshi Saitoh; Mitsuo Ueki; Keiichi Kobori, all of Kawasaki, Japan

[73] Assignee: Toshiba Tungaloy Co., Ltd., Kawasaki, Japan

[21] Appl. No.: 383,080

[22] Filed: Jul. 21, 1989

[30] Foreign Application Priority Data

Nov. 29, 1988 [JP] Japan ..... 63-300114

[51] Int. Cl.[5] ..... C22C 29/04

[52] U.S. Cl. ..... 75/238; 75/239; 75/242; 75/244; 419/13; 419/14; 419/16; 419/17

[58] Field of Search ..... 75/244, 238, 239, 242; 419/13, 14, 16, 17

[56] References Cited

U.S. PATENT DOCUMENTS

| | | | |
|---|---|---|---|
| 3,994,692 | 11/1976 | Rudy | 428/336 |
| 4,120,719 | 10/1978 | Nomura et al. | 75/238 |
| 4,636,252 | 1/1987 | Yoshimura et al. | 75/238 |
| 4,769,070 | 9/1988 | Tobioka et al. | 75/238 |
| 4,857,108 | 8/1989 | Brand et al. | 75/238 |

*Primary Examiner*—Stephen J. Lechert, Jr.
*Assistant Examiner*—Leon Nigohosian, Jr.
*Attorney, Agent, or Firm*—Foley & Lardner, Schwartz, Jeffery, Schwaab, Mack, Blumenthal & Evans

[57] ABSTRACT

There are disclosed a high strength nitrogen-containing cermet which comprises 7 to 20% by weight of a binder phase composed mainly of Co and/or Ni, with the balance being a hard phase composed mainly of TiC, TiN and/or Ti(C,N) and inevitable impurities, wherein the hard phase comprises 35 to 59% by weight of Ti, 9 to 29% by weight of W, 0.4 to 3.5% by weight of Mo, 4 to 24% by weight of at least one of Ta, Nb, V and Zr, 5.5 to 9.5% by weight of N and 4.5 to 12% by weight of C; and a process for preparing the same which comprises via the formulating, mixing, drying, molding and sintering steps of Co and/or Ni powder, at least one powder of TiC, Ti(C,N) and TiN, WC powder, Mo and/or $Mo_2C$, and at least one powder of carbides of Ta, Nb, V and Zr, wherein the sintering step is carried out by elevating the temperature up to 1350° C. in vacuum, with the nitrogen atmosphere being made 1 torr at 1350° C., increasing gradually the partial nitrogen pressure along with temperature elevation from 1350° C. to the sintering temperature, with the nitrogen atmosphere being made 5 torr at the sintering temperature.

18 Claims, No Drawings

HIGH STRENGTH NITROGEN-CONTAINING CERMET AND PROCESS FOR PREPARATION THEREOF

BACKGROUND OF THE INVENTION

This invention relates to a cermet composed mainly of titanium carbide, titanium nitride and/or titanium carbonitride, specifically to a high strength nitrogen-containing cermet suitable as the material for cutting tools, such as lathe cutting tools, milling cutter tools, drills, end mills, etc., or the material for wear resistant tools, including slitter, cutting blade and mold tools such as dies for can making, etc., or the material for decorative articles such as watch case, brooch, necktie pin, etc.

Generally speaking, a N (nitrogen)-containing TiC-based cermet with a basic composition of TiC-TiN-Ni tends to be more excellent in strength and plastic deformation resistance as compared with a N-non-containing TiC-based cermet with a basic composition of TiC-Ni. For this reason, the main subject of research and development of TiC-based cermet is becoming in recent years the N-containing TiC-based cermet.

The N-containing TiC-based cermet at the initial stage of development tends to be smaller in N content as 5 to 20% by weight calculated in terms of TiN, but as the effect of containing N becomes evident, it has been investigated to increase the N content, thereby making its effect still greater. As a representative example of the TiC-based cermet with much N content, there is Japanese Patent Publication No. 3017/1988.

Japanese Patent Publication No. 3017/1988 discloses a cermet for cutting tool, having a composition comprising titanium nitride: 25–45% by weight, titanium carbide: 15–35% by weight, tungsten carbide: 10–30% by weight, at least one carbides of Ta, Nb, V and Zr: 5–25% by weight, and Co or Co and Ni (provided that Co>Ni): 7.5–25% by weight, and its hard dispersed phases consisting of the two phases. The one is a NaCl type solid solution phase with the structure comprising titanium carbide as the core and a solid solution of at least one of carbides of Ta, Nb and Zr, tungsten carbide, titanium carbide and titanium nitride surrounding therearound (rim), and the other is a titanium nitride phase, while a binder phase comprises Co, or Co and Ni in which W and Ti exist as solid solution. The cermet disclosed in the published specification, in order to cope with the problem of the TiC-based cermet with much TiN content of the prior art that it has low sinterability and is difficult to obtain high density, provides a readily sinterable and dense cermet by improvement of wettability between the hard dispersed phase and the binder phase by adding no Mo or $Mo_2C$. However, since no Mo or $Mo_2C$ is added, the dispersed phase becomes coarse, and also the particle sizes tend to become non-uniform, whereby there is involved the problem that the advantage of addition of a large amount of TiN to improve strength cannot be fully exhibited.

SUMMARY OF THE INVENTION

The present invention has solved the problem as described above, and specifically, its object is to provide a nitrogen-containing cermet comprising optimum amount of Mo or $Mo_2C$ in a TiC-based cermet with much nitrogen content, which has fine and uniform hard phase and also excellent strength and a process for producing the same.

The present inventors have investigated in order to extract the effect of containing N to the maximum extent by making the hard phase of the TiC-based cermet with much N content fine and uniform, thereby making a cermet of high strength, and consequently noted first that Mo and W can form nitrides with difficulty, and although both have great effect of forming fine particles of hard phases by inhibiting dissolution-precipitation mechanism, W is more greater in the effect of forming fine particles of hard phase by inhibiting dissolution-precipitation mechanism because of greater difficulty in formation of nitride, and therefore there is the possibility that high strength with fine particle structure can be obtained also when no Mo or $Mo_2C$ is added at all as in Japanese Patent Publication No. 3017/1988. However, the liquid phase emergence temperature is 1270° C. for the TiC-Ni system, 1370° C. to 1445° C. for the WC-Ni system, thus being higher for the WC-Ni system, whereby combining growth of TiC occurs before emergence of a liquid phase containing a large amount of WC, whereby a first finding was obtained that the alloy structure, although fine, becomes a non-uniform structure containing partially coarse particles of TiC.

Next, the liquid phase emergence temperature of $Mo_2C$-Ni system is 1252° C. which is lower than the TiC-Ni system, and a rim of carbonitride containing Mo is formed around TiC particles before combining growth of TiC, whereby a second finding was obtained that fine particle structure is formed by inhibiting combining growth of TiC, and also the hard phases become fine and uniform by the optimum amount of Mo or $Mo_2C$ even in the case of much N content.

The present invention has been accomplished on the first and the second findings.

More specifically, the high strength nitrogen-containing cermet of the present invention comprises 7 to 20% by weight of a binder phase composed mainly of Co and/or Ni, with the balance being a hard phase composed mainly of titanium carbide, titanium nitride and/or titanium carbonitride and inevitable impurities, wherein said hard phase comprises 35 to 59% by weight of titanium (Ti), 9 to 29% by weight of tungsten (W), 0.4 to 3.5% by weight of molybdenum (Mo), 4 to 24% by weight of at least one of tantalum (Ta), niobium (Nb), vanadium (V) and zirconium (Zr), 5.5 to 9.5% by weight of nitrogen (N) and 4.5 to 12 by weight of carbon (C).

Also, the process for preparing the high strength nitrogen-containing cermet is a process obtaining a cermet comprising 7 to 20% by weight of a binder phase composed mainly of Co and/or Ni, with the balance being a hard phase composed mainly of titanium carbide, titanium nitride and/or titanium carbonitride and inevitable impurities, wherein said hard phase comprises 35 to 59% by weight of Ti, 9 to 29% by weight of W, 0.4 to 3.5% by weight of Mo, 4 to 24% by weight of at least one of Ta, Nb, V and Zr, 5.5 to 9.5% by weight of N and 4.5 to 12% by weight of C, via the formulating, mixing, drying, molding and sintering steps of Co and/or Ni powder, at least one powder of titanium carbide, titanium carbonitride and titanium nitride, tungsten carbide powder, molybdenum and/or molybdenum carbide, and at least one powder of carbides of Ta, Nb, V and Zr, wherein said sintering step is carried out by elevating the temperature up to 1350° C. in vacuum, with the nitrogen atmosphere being made 1 torr at 1350° C., increasing gradually the partial nitrogen pressure along with temperature elevation from 1350° C. to the sintering temperature with the nitrogen atmosphere being made 5 torr at the sintering temperature.

DESCRIPTION OF THE PREFERRED EMBODIMENTS

The binder phase in the high strength nitrogen containing cermet of the present invention comprises primarily Co or Ni, or Co and Ni, and the elements for forming the hard phase such as W, Mo, Ta, Nb, V, Zr, etc., or impurities such as Fe, Cr, etc. introduced from the preparation steps may sometimes exist in minute amount as solid solution in the binder phase. If the binder phase is less than 7% by weight, it becomes difficult to obtain a dense and high strength cermet, while on the contrary, if it becomes more in excess of 20% by weight, plastic deformation resistance and heat resistance will be deteriorated. For this reason, the binder phase is defined as from 7 to 20% by weight.

The hard phase in the high strength nitrogen-containing cermet of the present invention includes the cases comprising a carbonitride, a carbonitride and a carbide, or a carbonitride, a carbide and a nitride. Particularly, the case where the main composition of a hard phase with a structure having a core, comprises a core of titanium carbide or titanium carbonitride, and a rim enclosing said core therein comprising a carbonitride containing Ti, W, Mo, at least one of Ta, Nb, V and Zr, is preferred, because it becomes to have a uniform fine grained structure and high strength. The hard phase of the structure having a core may include a first hard phase with the core of titanium carbide and the rim of a carbonitride containing Ti, W, Mo, at least one of Ta, Nb, V and Zr, and a second hard phase with the core of titanium carbonitride and the rim of carbonitride containing Ti, W, Mo, at least one of Ta, Nb, V and Zr. As the form of the hard phase in the present invention, specifically, there may include, for example, the case comprising the first hard phase, the second hard phase and a third hard phase comprising titanium nitride, the case comprising the first hard phase and the third hard phase, the case comprising the second hard phase and the third hard phase, the case comprising the first hard phase and the second hard phase, or the case comprising the second hard phase. These forms of hard phase may differ depending on the starting materials, the preparing conditions such as sintering temperature, etc. and the composition of the components.

In the hard phase, the amount of Ti is set within the range of 35 to 59% by weight. If the amount of Ti is less than 35% by weight, wear resistance is lowered. On the other hand, if it exceeds 59% by weight, toughness is lowered.

The amount of W is set within the range of 9 to 29% by weight, more preferably in the range of 15 to 25% by weight. By setting the amount of W in this range, the rim of the hard phase is relatively stably and uniformly formed, and W is melted in the binder phase in the form of a solid solution to strengthen the binder phase. If the amount is less than 9% by weight, the above effect is insufficient, while it exceeds 29% by weight, WC phase is revealed so that strength will be lowered.

The amount of Mo is set within the range of 0.4 to 3.5% by weight. In this range, the cermet becomes uniform and fine particle composition with good sinterability even when high N content, and yet strength of the cermet increases. If the amount is less than 0.4% by weight, particle size of hard phase becomes ununiform and strength of the cermet is lowered. If it exceeds 3.5% by weight, sinterability is lowered.

The amount of at least one of Ta, Nb, V and Zr is set within the range of 4 to 24% by weight. In this range, these metals are melted in the hard phase in the form of a solid solution whereby they grow up the rim of the hard phase stably and increase strength of the cermet. Also, they have a function of improving plastic deformation resistance of the cermet. If it is less than 4% by weight, the above effects cannot be obtained, while it exceeds 24% by weight, a soften rim becomes too thick whereby wear resistance becomes low. When the ratio of (at least one of Ta and Nb) : (at least one of V and Zr) is within the range of (70 to 98) : (30 to 2) in terms of weight ratio (which correspond to 3.92 to 23.52% by weight of at least one of Ta and Nb and 0.08 to 7.2% by weight of at least one of V and Zr in the cermet), these metals are melted in the hard phase in the form of a solid solution to increase strength of the hard phase. When it comprises at least one of Ta and Nb, the amount is preferably 4 to 10% by weight in the cermet. When it comprises at least one of Ta and Nb and at least one of V an Zr, the amounts thereof are preferably 0.1 to 4% by weight of at least V and Zr and the remainder of at least one of Ta and Nb in the cermet.

The amount of N is set within the range of 5.5 to 9.5% by weight. By setting the amount in the above range, structure of the cermet becomes fine, the binder phase is strengthened, and the cermet becomes an alloy excellent in plastic deformation resistance and wear resistance as well as thermal impact resistance. If it is less than 5.5% by weight, the structure becomes coarse, the binder phase becomes soften and plastic deformation resistance, thermal conductivity and thermal impact resistance are lowered. If it exceeds 9.5% by weight, sinterability is lowered whereby strength of the cermet is also lowered, and further the hard phase is softened whereby wear resistance is lowered.

The amount of C is set within the range of 4.5 to 12% by weight. In this range, neither free carbon nor precipitated phase composed of $TiNi_3$, $M_6C$ and $M_{12}C$ type is formed (where M represents a metal element contained and mainly Ti).

Inevitable impurities in the high strength nitrogen containing cermet may include those introduced from the starting materials and from the course of the preparation steps. As the inevitable impurity remaining in the sintered alloy as related to both of the starting materials and the preparation steps, there is oxygen. The amount of oxygen remaining in the alloy may be permissible within 1% by weight or less, but for making dense, fine and uniform structure, it is particularly preferably made 0.5% by weight or less.

The high strength nitrogen-containing cermet of the present invention can be prepared by the preparation process according to powder metallurgy which has been practiced in the prior art, but it is particularly preferred to practice the process as described above, because denitrification in the alloy can be prevented and yet control of the nitrogen amount contained becomes easier.

In the process for preparing the high strength nitrogen-containing cermet of the present invention, vacuum means a pressure of, for example, $10^{-1}$ torr to $10^{-5}$ torr, and the sintering temperature means, for example, a temperature of 1450° C. to 1550° C., which temperature state is maintained for 30 minutes to 90 minutes.

The high strength nitrogen-containing cermet of the present invention has titanium existing in hard phases together with C and N, primarily as titanium carbide, titanium carbonitride, titanium nitride, and among them, titanium carbonitride and titanium nitride perform the action of making finer the hard phase and the action of strengthening the binder phase in the alloy structure, and titanium carbide and titanium carbonitride act to enhance wear resistance. Also, Mo existing in the hard phase has the action of making hard phases uniform and fine, thereby enhancing the strength of alloy. Further, among W, Ta, Nb, V and Zr, W has the action of strengthening the binder phase simultaneously with making finer the hard phase, and other metal elements form composite carbonitrides together with Ti, Mo and W, thereby acting to improve strength, plastic deformation resistance and heat resistance of the alloy.

EXAMPLE 1

By use of TiC powder with an average particle size of 2 μm, TNN powder with an average particle size of 1.26 μm, Ti(C,N) powder with an average particle size of 1.5 μm, WC powder with an average particle size of 1.5 μm, TaC powder with an average particle size of 1.0 μm, NbC powder with an average particle size of 1.2 μm, VC powder with an average particle size of 2.5 μm, ZrC powder with an average particle size of 1.4 μm, $Mo_2C$ powder with an average particle size of 1.5 μm, Co powder with an average particle size of 1.3 μm and Ni powder with an average particle size of 5 μm as the starting materials, respective samples were formulated pulverized together with balls made of cemented carbide in a wet ball mill with acetone solvent for 40 hours. After paraffin addition, drying and press molding, the products of the present invention were sintered by elevating the temperature in vacuum of $10^{-2}$ torr up to 1350° C., with the atmosphere being made 1 torr nitrogen atmosphere at 1350° C., gradually increased in partial nitrogen pressure with temperature elevation from 1350° C. to 1500° C. and maintaining the sintering temperature at 1500° C. for one hour, the comparative products No.s 1 to 6 were sintered by making the atmosphere up to 1500° C. as shown in Table 1, and maintaining a temperature at 1500° C. for one hour.

The products of the present invention No.s 1 to 9 and comparative products No.s 1 to 6 were observed by a metallurgical microscope, and the classification of the pores generated in the sintered alloy according to ISO standard 4505 are shown in Table 2 and also the sintered alloy compositions are shown together in Table 2. Also, the constitutional structures of hard phases existing in the sintered alloys of the respective samples, the oxygen contents in the alloys and the numbers of the hard phase particles with particle sizes of 1.5 μm or more which is observed in a view by a metallurgical microscope with a magnification of 2,000 were determined and shown in Table 3. Further, the hardnesses and transverse-rupture strength of the respective samples were determined, and the results obtained are shown in Table 4. The cutting tests were also conducted under the conditions (A) and (B) shown below to obtain the results shown in Table 4.

TABLE 1

| Sample No. | | Formulating composition (% by weight) | | | | | | | | | | | Sintering conditions | |
|---|---|---|---|---|---|---|---|---|---|---|---|---|---|---|
| | | TiC | TiN | Ti(C,N) | TaC | NbC | VC | ZrC | WC | $Mo_2C$ | Co | Ni | Atmosphere | Temperature(°C.) |
| Product of this invention | 1 | 25.4 | 28.0 | — | 5.9 | — | 0.6 | 0.2 | 20.1 | 1.8 | 18.0 | — | $N_2$ gradually increased | 1500 |
| | 2 | 24.1 | 35.2 | — | 6.0 | — | — | 0.5 | 15.2 | 1.0 | 10.5 | 7.5 | $N_2$ gradually increased | 1500 |
| | 3 | 32.3 | 26.0 | — | 4.8 | 2.3 | 2.4 | 0.1 | 17.6 | 1.5 | 13.0 | — | $N_2$ gradually increased | 1500 |
| | 4 | 24.1 | 25.5 | — | 6.3 | — | 1.2 | 0.2 | 28.1 | 1.6 | 7.0 | 6.0 | $N_2$ gradually increased | 1500 |
| | 5 | — | — | 61.7 | 5.8 | — | — | 1.5 | 16.3 | 1.2 | 13.5 | — | $N_2$ gradually increased | 1500 |
| | 6 | 21.0 | 37.5 | — | 4.0 | 1.2 | — | 0.8 | 21.3 | 0.7 | 9.0 | 4.5 | $N_2$ gradually increased | 1500 |
| | 7 | 34.9 | 39.3 | — | 5.4 | — | — | 0.2 | 12.1 | 0.6 | 7.5 | — | $N_2$ gradually increased | 1500 |
| | 8 | — | 7.8 | 53.7 | 4.9 | — | — | 0.5 | 25.0 | 0.6 | 6.0 | 1.5 | $N_2$ gradually increased | 1500 |
| | 9 | 29.0 | 28.0 | — | 7.0 | — | 3.0 | — | 18.0 | 1.0 | 7.0 | 7.0 | $N_2$ gradually increased | 1500 |
| Comparative product | 1 | — | — | 44.4 | 10.5 | 4.3 | — | — | 25.2 | 1.5 | 14.1 | — | Vacuum | 1500 |
| | 2 | 21.3 | 45.3 | — | 7.2 | — | — | — | 12.1 | 0.8 | 13.3 | — | 10 torr $N_2$ | 1500 |
| | 3 | 34.5 | 38.0 | — | 12.0 | — | — | 0.6 | 3.5 | 0.9 | 10.5 | — | 5 torr $N_2$ | 1500 |
| | 4 | 20.5 | 26.0 | — | 5.1 | — | — | — | 34.1 | 1.8 | 8.3 | 4.2 | Vacuum | 1500 |
| | 5 | 21.8 | 34.1 | — | 8.3 | — | — | 2.0 | 18.8 | — | 10.0 | 5.0 | 5 torr $N_2$ | 1500 |
| | 6 | 21.7 | 33.0 | — | 8.8 | 1.0 | — | 0.5 | 12.7 | 5.8 | 11.0 | 5.5 | 5 torr $N_2$ | 1500 |

as shown in Table 1, and these samples were mixed and

TABLE 2

| Sample No. | | Sintered alloy composition (% by weight) | | | | | | | | | | | Classification of pores generated |
|---|---|---|---|---|---|---|---|---|---|---|---|---|---|
| | | Ti | W | Mo | Ta | Nb | V | Zr | N | C | Co | Ni | |
| Product of this invention | 1 | 42.0 | 18.9 | 1.7 | 5.5 | — | 0.5 | 0.2 | 6.3 | 6.9 | 18.0 | — | A-1 or less |
| | 2 | 46.6 | 14.3 | 0.9 | 5.6 | — | — | 0.4 | 7.9 | 6.3 | 10.5 | 7.5 | A-1 or less |
| | 3 | 45.8 | 16.5 | 1.4 | 4.5 | 2.0 | 2.0 | 0.1 | 5.9 | 8.8 | 13.0 | — | A-1 or less |
| | 4 | 38.9 | 26.4 | 1.5 | 5.9 | — | 1.0 | 0.2 | 5.8 | 7.3 | 7.0 | 6.0 | A-1 or less |
| | 5 | 48.5 | 15.3 | 1.1 | 5.4 | — | — | 1.3 | 7.1 | 7.8 | 13.5 | — | A-1 or less |
| | 6 | 45.8 | 20.0 | 0.7 | 3.8 | 1.1 | — | 0.7 | 8.5 | 5.9 | 9.0 | 4.5 | A-1 or less |
| | 7 | 58.3 | 11.4 | 0.6 | 5.1 | — | — | 0.2 | 8.9 | 8.0 | 7.5 | — | A-1 |
| | 8 | 48.2 | 23.5 | 0.6 | 4.6 | — | — | 0.4 | 8.0 | 7.2 | 6.0 | 1.5 | A-1 or less |

TABLE 2-continued

| Sample No. | | Sintered alloy composition (% by weight) Ti | W | Mo | Ta | Nb | V | Zr | N | C | Co | Ni | Classification of pores generated |
|---|---|---|---|---|---|---|---|---|---|---|---|---|---|
| | 9 | 44.9 | 16.9 | 0.9 | 6.6 | — | 2.4 | — | 6.3 | 8.0 | 7.0 | 7.0 | A-1 or less |
| Com- | 1 | 34.9 | 23.7 | 1.4 | 9.8 | 3.8 | — | — | 5.1 | 7.2 | 14.1 | — | A-1 or less |
| para- | 2 | 52.1 | 11.4 | 0.8 | 6.8 | — | — | — | 10.2 | 5.4 | 13.3 | — | A-4 |
| tive | 3 | 57.0 | 3.3 | 0.8 | 11.3 | — | — | 0.5 | 8.6 | 8.0 | 10.5 | — | A-2 |
| product | 4 | 36.5 | 32.0 | 1.7 | 4.8 | — | — | — | 5.9 | 6.6 | 8.3 | 4.2 | A-1 or less |
| | 5 | 43.8 | 17.6 | — | 7.8 | — | — | 1.8 | 7.7 | 6.3 | 10.0 | 5.0 | A-1 |
| | 6 | 42.9 | 11.9 | 5.5 | 8.3 | 0.9 | — | 0.4 | 7.5 | 6.1 | 11.0 | 5.5 | A-4 |

TABLE 3

| Sample No. | | Constitutional structures of hard phase existing in the sintered alloy Core | Rim | Other hard phase | Oxygen content in the alloy (wt %) | Number of hard phase particles with size of 1.5 μm or more* |
|---|---|---|---|---|---|---|
| Product | 1 | TiC | (Ti,Ta,V,Zr,W,Mo)(C,N) | TiN | 0.32 | 4 |
| of | 2 | TiC | (Ti,Ta,Zr,W,Mo)(C,N) | TiN | 0.35 | 2 |
| this | 3 | TiC | (Ti,Ta,Nb,V,Zr,W,Mo)(C,N) | TiN | 0.26 | 3 |
| inven- | 4 | TiC | (Ti,Ta,W,V,Zr,Mo)(C,N) | TiN | 0.49 | 3 |
| tion | 5 | Ti(C,N) | (Ti,Ta,Zr,W,Mo)(C,N) | — | 0.30 | 1 |
| | 6 | TiC | (Ti,Ta,Nb,Zr,W,Mo)(C,N) | TiN | 0.29 | 2 |
| | 7 | TiC | (Ti,Ta,Zr,W,Mo)(C,N) | TiN | 0.39 | 3 |
| | 8 | Ti(C,N) | (Ti,Ta,Zr,W,Mo)(C,N) | TiN | 0.41 | 2 |
| | 9 | TiC | (Ti,W,Mo,V,Ta)(C,N) | TiN | 0.45 | 3 |
| Com- | 1 | Ti(C,N) | (Ti,Ta,Nb,W,Mo)(C,N) | — | 0.53 | 5 |
| para- | 2 | TiC | (Ti,Ta,W,Mo)(C,N) | TiN | 0.35 | 9 |
| tive | 3 | TiC | (Ti,Ta,Zr,W,Mo)(C,N) | TiN | 0.26 | 7 |
| product | 4 | TiC | (Ti,Ta,W,Mo)(C,N) | TiN | 0.70 | 10 |
| | 5 | TiC | (Ti,Ta,Zr,W)(C,N) | TiN | 0.29 | 13 |
| | 6 | TiC | (Ti,Ta,Nb,Zr,W,Mo)(C,N) | TiN | 0.39 | 9 |

*in a view of metallurgical microscope with × 2,000.

(A) Continuous lathe cutting test
Work: S48C ($H_B$ 236)
Cutting Speed: 250 m/min
Feed: 0.3 mm/rev
Cutting depth: 1.5 mm
Tip shape: SPGN 120308 (0.1×−30° equipped with pre-horning)
Evaluation: average flank wear ($V_B$) and face wear ($K_T$) after 5 min cutting were measured.
(B) Intermittent lathe cutting test
Work: S48C ($H_B$ 226) with four slots
Cutting speed: 100 m/min
Feed: 0.2 mm/rev
Cutting depth: 1.5 mm
Tip shape: SPGN 120308 (0.1×−30° equipped with horning)
Evaluation: number of impact to fracture (average of 4 repetitions)

The high strength nitrogen-containing cermet of the present invention has hard phase particles which are more uniformly fine, slightly higher hardness and transverse-rupture strength and slightly more excellent flank wear resistance and face wear resistance as compared with the cermets of outside the scope of the present invention, whereby there is the effect that fracturing resistance by the cutting test is remarkably improved. That is, if the composition of the present invention is made to improve fracturing resistance, the fracturing resistance can be improved without remarkable decrease in wear resistance. Also, if the composition of the same is made to improve wear resistance the wear resistance can be remarkably improved without remarkable decrease in fracturing resistance. From these facts, the high strength nitrogen-containing cermet of the present invention is an industrially useful material which has been made available from the use region for the nitro-

TABLE 4

| Sample No. | | Hardness (Hv) | Transverse-rupture strength (kgf/mm²) | (A) Continuous lathe cutting test $V_B$ (mm) | $K_T$ (μm) | (B) Number of impact to fracture in intermittent lathe cutting |
|---|---|---|---|---|---|---|
| Product | 1 | 1510 | 172 | 0.32 | 40 | 3208 |
| of | 2 | 1495 | 173 | 0.33 | 45 | 3541 |
| this | 3 | 1550 | 171 | 0.20 | 25 | 2982 |
| inven- | 4 | 1550 | 175 | 0.22 | 25 | 3415 |
| tion | 5 | 1560 | 169 | 0.19 | 15 | 2645 |
| | 6 | 1565 | 178 | 0.17 | 20 | 3258 |
| | 7 | 1580 | 165 | 0.13 | 15 | 2614 |
| | 8 | 1585 | 159 | 0.14 | 10 | 3354 |
| | 9 | 1550 | 170 | 0.22 | 20 | 3018 |
| Com- | 1 | 1530 | 135 | 0.30 | 30 | 2044 |
| para- | 2 | 1550 | 141 | 0.25 | 20 | 1501 |
| tive | 3 | 1540 | 127 | 0.21 | 40 | 1354 |
| product | 4 | 1535 | 156 | 0.40 | 85 | 2790 |
| | 5 | 1520 | 163 | 0.35 | 70 | 2257 |
| | 6 | 1505 | 172 | 0.38 | 60 | 1959 |

gen-containing cermet of the prior art to the region where further impact resistance is required.

We claim:

1. A high strength nitrogen-containing cermet comprising 7 to 20% by weight of a binder phase composed mainly of Co and/or Ni, with the balance being a hard phase composed mainly of titanium carbide, titanium nitride and/or titanium carbonitride and inevitable impurities, wherein said hard phase comprises 35 to 59% by weight of titanium (Ti), 9 to 29% by weight of tungsten (W), 0.4 to 3.5% by weight of molybdenum (Mo), 4 to 24% by weight of elements selected from the group consisting of tantalum (Ta), niobium (Nb), vanadium (B) and zirconium (Zr), 5.5 to 9.5% by weight of nitrogen (N) and 4.5 to 12% by weight of carbon (C) wherein the cermet includes (1) at least one of Ta and Nb and (2) at least one of Zr and a mixture of V and Zr, the weight ratio of (1):(2) being in the range of 70–98:-30–2.

2. A high strength nitrogen-containing cermet according to claim 1, wherein said hard phase is selected from the group consisting of (a) a carbonitride, (b) a carbonitride and a carbide, and (c) a carbonitride, a carbide and a nitride.

3. A high strength nitrogen-containing cermet according to claim 1, wherein said hard phase has a structure having a core composed of titanium carbide or titanium carbonitride and a rim enclosing said core, said rim composed of a carbonitride containing Ti, W, Mo, at least one of Ta and Nb, and at least one of Zr and a mixture of V and Zr.

4. A high strength nitrogen-containing cermet according to claim 2, wherein said hard phase includes a first hard phase with the core of titanium carbide and the rim of a carbonitride containing Ti, W, Mo, at least one of Ta, Nb, and at least one of Zr and a mixture of V and Zr, and a second hard phase with the core of titanium carbonitride containing Ti, W, Mo and at least one of Ta, Nb, V and Zr.

5. A high strength nitrogen-containing cermet according to claim 4, wherein said hard phase further comprises a third hard phase composed of titanium nitride.

6. A high strength nitrogen-containing cermet according to claim 2, wherein said hard phase includes a first hard phase with a core of titanium carbide and a rim of a carbonitride containing Ti, W, Mo, at least one of Ta and Nb, and at least one of Zr and a mixture of V and Zr, and third hard phase composed of titanium nitride.

7. A high strength nitrogen-containing cermet according to claim 2, wherein said hard phase includes a second hard phase with the core of titanium carbonitride containing Ti, W, Mo, at least one of Ta and Nb, and at least one of Zr and a mixture of V and Zr, and a third hard phase composed of titanium nitride.

8. A high strength nitrogen-containing cermet according to claim 2, wherein said hard phase includes a second hard phase with the core of titanium carbonitride containing Ti, W, Mo, at least one of Ta and Nb, and at least one of Zr and a mixture of V and Zr.

9. A process for preparing a high strength nitrogen-containing cermet, which is a process for obtaining a cermet comprising 7 to 20% by weight of a binder phase composed mainly of Co and/or Ni, with the balance being a hard phase composed mainly of titanium carbide, titanium nitride and/or titanium carbonitride and inevitable impurities, wherein said hard phase comprises 35 to 59% by weight of titanium (Ti), 9 to 29% by weight of tungsten (W), 0.4 to 3.5% by weight of molybdenum (Mo), 4 to 24% by weight of elements selected from the group consisting of tantalum (Ta), niobium (Nb), vanadium (V) and zirconium (Zr), 5.5 to 9.5% by weight of nitrogen (N) and 4.5 to 12% by weight of carbon (C), wherein the cermet includes (1) at least one of Ta and Nb and (2) at least one of Zr and a mixture of V and Zr, the weight ratio of (1):(2) being in the range of 70–98:30–2 via formulating, mixing, drying, molding and sintering steps of Co and/or Ni powder, at least one powder of titanium carbide, titanium carbonitride and titanium nitride, tungsten carbide powder, molybdenum and/or molybdenum carbide, at least one powder of carbides of Ta and Nb, and at least one of zirconium carbide powder and a mixture of V and Zr carbide powders, wherein said sintering step is carried out by elevating the temperature up to 1350° C. in vacuum, with the nitrogen atmosphere being made 1 torr at 1350° C., increasing gradually the partial nitrogen pressure along with temperature elevation from 1350° C. to the sintering temperature, with the nitrogen atmosphere being made 5 torr at the sintering temperature.

10. A process for preparing a high strength nitrogen-containing cermet according to claim 9, wherein said vacuum is a pressure of $10^{-1}$ torr to $10^{-5}$ torr.

11. A process for preparing a high strength nitrogen-containing cermet according to claim 9, wherein said sintering temperature is 1450° C. to 1550° C.

12. A process for preparing a high strength nitrogen-containing cermet according to claim 11, wherein said sintering temperature is maintained for 30 minutes to 90 minutes.

13. A high-strength nitrogen-containing cermet according to claim 1, wherein the hard phase consists essentially of 35 to 59% by weight of titanium, 9 to 29% by weight of tungsten, 0.4 to 3.5% by weight of molybdenum, 4 to 24% by weight of elements selected from the group consisting of tantalum, niobium, vanadium and zirconium, 5.5 to 9.5% by weight of nitrogen and 4.5 to 12% by weight of carbon.

14. A process according to claim 9, wherein the hard phase consists essentially of 35 to 59% by weight of titanium, 9 to 29% by weight of tungsten, 0.4 to 3.5% by weight of molybdenum, 4 to 24% by weight of elements selected from the group consisting of tantalum, niobium, vanadium and zirconium, 5.5 to 9.5% by weight of nitrogen and 4.5 to 12% by weight of carbon.

15. A high-strength nitrogen-containing cermet according to claim 13, wherein the amount of zirconium or the mixture of vanadium and zirconium is 0.1 to 4% by weight.

16. A high-strength nitrogen-containing cermet according to claim 15, wherein the amount of molybdenum is 15 to 25% by weight.

17. A high-strength nitrogen-containing cermet according to claim 1, wherein the cermet includes a mixture of vanadium and zirconium.

18. A process according to claim 9, wherein the cermet includes a mixture of vanadium and zirconium.

* * * * *